US006067015A

United States Patent [19]

Lian et al.

[11] Patent Number: 6,067,015

[45] Date of Patent: May 23, 2000

[54] MAGNETOMECHANICAL EAS MARKER WITH REDUCED-SIZE BIAS MAGNET

[75] Inventors: Ming-Ren Lian, Boca Raton; Dennis M. Gadonniex, Delray Beach; Richard Tellshow, Boynton Beach, all of Fla.

[73] Assignee: Senormatic Electronics Corporation, Boca Raton, Fla.

[21] Appl. No.: 09/112,582

[22] Filed: Jul. 9, 1998

[51] Int. Cl.[7] ..... G08B 13/14

[52] U.S. Cl. ..... 340/572.1; 340/572.6; 340/572.8; 340/568.1; 340/551; 340/571

[58] Field of Search ..... 340/572.1, 572.6, 340/572.2, 572.3, 572.8, 551, 568.1, 571

[56] References Cited

U.S. PATENT DOCUMENTS 4,510,489 4/1985 Anderson, III et al. ..... 340/572
4,510,490 4/1985 Anderson, III et al. ..... 340/572.1
4,622,543 11/1986 Anderson, III et al. ..... 340/572.1
5,469,140 11/1995 Liu et al. ..... 340/551
5,568,125 10/1996 Liu ..... 340/551
5,729,200 3/1998 Copeland et al. ..... 340/551

*Primary Examiner*—Nina Tong
*Attorney, Agent, or Firm*—Robin, Blecker & Daley

[57] ABSTRACT

A magnetomechanical EAS marker includes a housing, a magnetostrictive active element in the housing, and a bias magnet mounted on the housing adjacent to the active element. Both the active element and the bias magnet are substantially planar metal strips. The length and/or surface area of the bias magnet is substantially less than the length and/or surface area of the active element. The reduction in the size of the bias magnet relative to the active element enhances reliable deactivation of the marker by increasing the resonant frequency shift obtained by degaussing the bias magnet. The increased reliability of deactivation is obtained without increasing the sensitivity of the marker, when in an active state, to variations in applied bias magnetic field.

21 Claims, 6 Drawing Sheets

MAGNETOMECHANICAL EAS MARKER WITH REDUCED-SIZE BIAS MAGNET

FIELD OF THE INVENTION

This invention relates to magnetomechanical electronic article surveillance (EAS) markers.

BACKGROUND OF THE INVENTION

U.S. Pat. No. 4,510,489, issued to Anderson et al., discloses a magnetomechanical electronic article surveillance (EAS) system in which markers incorporating a magnetostrictive active element are secured to articles to be protected from theft. The active elements are formed of a soft magnetic material, and the markers also include a control element which is biased or magnetized to a pre-determined degree so as to provide a bias field which causes the active element to be mechanically resonant at a pre-determined frequency. The markers are detected by means of an interrogation signal generating device which generates an alternating magnetic field at the pre-determined resonant frequency, and the signal resulting from the mechanical resonance is detected by receiving equipment.

According to one embodiment disclosed in the Anderson et al. patent, the interrogation signal is turned on and off, or "pulsed," and a "ring-down" signal generated by the active element after conclusion of each interrogation signal pulse is detected.

Typically, magnetomechanical markers are deactivated by degaussing the control element, so that the bias field is removed from the active element thereby causing a substantial shift in the resonant frequency of the active element.

FIG. 1 is a somewhat schematic, exploded isometric view of a magnetomechanical EAS marker of the type disclosed in the Anderson et al. Parent. In FIG. 1, reference numeral 20 generally indicates the magnetomechanical marker. The marker 20 includes a housing 22 which defines a recess 24 in which the magnetostrictive active element (reference numeral 26) is housed. A bias or control element 28 is secured to the housing 22 at a position adjacent to the active element 26. As seen from FIG. 1, both the active and bias elements are in the form of thin, planar, ribbon-shaped strips of materials having magnetic characteristics suitable for the respective functions of the two elements. Conventional materials used for the active and bias elements are metal alloys.

FIG. 2 illustrates typical resonant frequency and output signal amplitude characteristics exhibited by a known magnetomechanical EAS marker, as functions of the effective bias field applied to the active element 26 by the bias magnet 28. In FIG. 2, curve 30 shows a bias-field-dependent output signal amplitude characteristic. Curve 30 is to be interpreted in conjunction with the right-hand vertical scale in FIG. 2. Specifically, curve 30 represents the so-called "A1" signal, which is the output signal level measured one millisecond after termination of an interrogation signal pulse. It will be observed that a peak value for the A1 signal occurs at a bias field level that is between 6 and 9 Oe.

Curve 32 in FIG. 2 indicates how the resonant frequency of the active element 26 varies according to the level of the effective bias field provided by the bias magnet 28. For the purposes of FIG. 2, the bias field is measured in the longitudinal direction of the marker, which is also the longitudinal direction of both the active element 26 and the bias magnet 28. Curve 32 is to be interpreted with reference to the left-hand vertical scale in FIG. 2.

In known magnetomechanical EAS markers it is customary to provide a bias magnet such that the effective bias field along the length of the active element is fairly close to the peak A1 signal level. In a typical magnetomechanical marker, the bias field provided by the bias magnet is about 6 Oe when the marker is in an active condition. In addition, the bias field level should be such that substantially degaussing the bias magnet, thereby reducing the applied bias field to a level of 2 Oe or below, results in a substantial shift in the resonant frequency of the active element, as well as a substantial reduction in the A1 output signal level. The resonant frequency shift, together with reduction in output signal level, helps to assure that the marker is "deactivated" i.e. that the marker will not be detected by the detection device provided at a store exit.

FIG. 3 presents in another form data represented by the resonant frequency characteristic curve 32 of FIG. 2.

The various data points shown in FIG. 3 correspond to respective bias field levels. The vertical position of each data point in FIG. 3 corresponds to the total shift in marker resonant frequency (deactivation frequency shift, or "DFS") if the bias field is reduced to 2 Oe from the respective bias field level corresponding to the data point. The horizontal position of the data point corresponds to the slope of curve 32 at the respective bias field level. (As a practical matter, for a given bias field level, the slope may be measured by applying a 0.5 Oe field in a first lengthwise direction of the marker and then in the opposite lengthwise direction, and noting the resulting difference in resonant frequency.)

The data shown in FIG. 3 indicates that the deactivation frequency shift, which is a desirable characteristic and is represented by the vertical scale, is positively correlated with the resonant-frequency-curve slope, which is represented by the horizontal scale and is a quantity that is to be minimized. The total frequency shift should be maximized, in order to minimize the possibility that a supposedly "deactivated" marker would be detected by detection equipment. On the other hand, the resonant-frequency-curve slope should be minimized, in order to reduce the chance that an "active" marker would fail to be detected. As discussed in U.S. Pat. No. 5,568,125, issued to Liu (and commonly assigned with the present application), the resonant frequency curve slope should be minimized to reduce the sensitivity of the marker to variations in the bias field. Bias field variations may arise due to manufacturing variations in regard to the bias magnet or other marker components, or as a result of the net additive or subtractive effect of the earth's magnetic field, depending on the orientation of the marker. To the extent that a marker is sensitive to bias field variations, the resonant frequency of the marker may be shifted from the nominal operating frequency of the detection equipment and may therefore be less likely to be detected by the detection equipment.

The positive correlation of DFS and resonant-frequency-curve slope, as indicated by FIG. 3, indicates that a trade-off must be made between reliable marker deactivation, provided by maximum DFS, and reliable marker detection, resulting from minimal sensitivity to bias field variations.

The Liu '125 patent, and co-pending patent application Ser. No. 08/800,771 (which is also commonly assigned with the present application) teach certain techniques for annealing the magnetostrictive active element and/or selecting the material of which the active element is formed, to ameliorate the trade-off between the desirable characteristic of maximum DFS, and the undesirable characteristic of elevated resonant-frequency-curve slope. It would, however, be attractive to provide additional techniques for ameliorating this trade-off, and it would be particularly helpful to improve this trade-off in a case where the active element is of a material that is used "as-cast", i.e. without annealing.

OBJECTS AND SUMMARY OF THE INVENTION

It is an object of the invention to provide a magnetomechanical EAS marker which exhibits a large deactivation frequency shift while being relatively insensitive to variations in bias magnetic field when in an active condition.

It is a further object of the invention to provide such a magnetomechanical EAS marker without applying an annealing process to the active element of the marker.

According to an aspect of the invention, there is provided a magnetomechanical EAS marker, including a magnetostrictive element, a bias magnet, and structure for mounting the magnetostrictive element and the bias magnet in proximity to each other; with the magnetostrictive element and the bias magnet both being substantially planar metal strips, the magnetostrictive element having a top surface area A and a longest dimension measuring L, and the bias magnet having a top surface area that is in a range of 0.30 A to less than 0.75 A and/or a longest dimension that is in the range of 0.50 L to less than 0.75 L. Preferably, the top surface area of the bias magnet is substantially 0.60 A and/or the bias magnet has a longest dimension of substantially 0.60 L. According to another preferred embodiment, the bias magnet has a top surface area of substantially 0.375 A and a width of substantially one-half the width of the magnetostrictive element.

The present applicants have found that, by reducing the size (length and/or surface area) of the bias magnet relative to the length or surface area of the active element, the deactivation frequency shift can be enhanced, while reducing the resonant-frequency-curve slope. Although prior-art magnetomechanical markers have employed bias magnets larger than the active element, as shown in FIG. 1, to smaller than the active element to the extent of as small as 0.75 times the area or length of the active element, no further reduction in the size of the bias magnet would have been indicated as desirable by the prior art, since any such reduction in bias magnet size tends to decrease the output signal (A1) level.

The present inventors have also found that a preferred balance between deactivation frequency shift and resonant frequency curve slope may be achieved by using novel bias magnet shapes corresponding to a rhombus, a triangle, or an ellipse.

DESCRIPTION OF PREFERRED EMBODIMENTS

Figure 1:
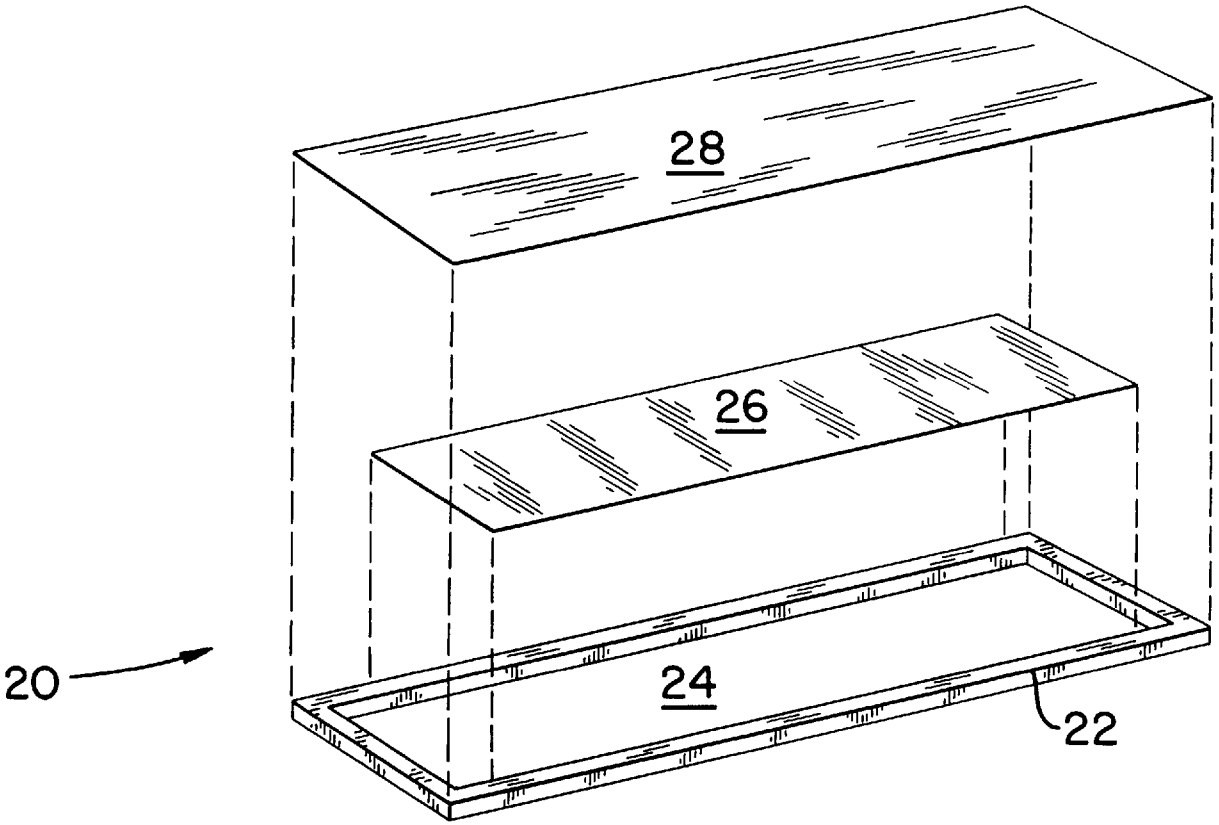
FIG. 1 (PRIOR ART)
FIG. 1 is a schematic, exploded isometric view of a magnetomechanical marker according to the prior art.
Figure 2:
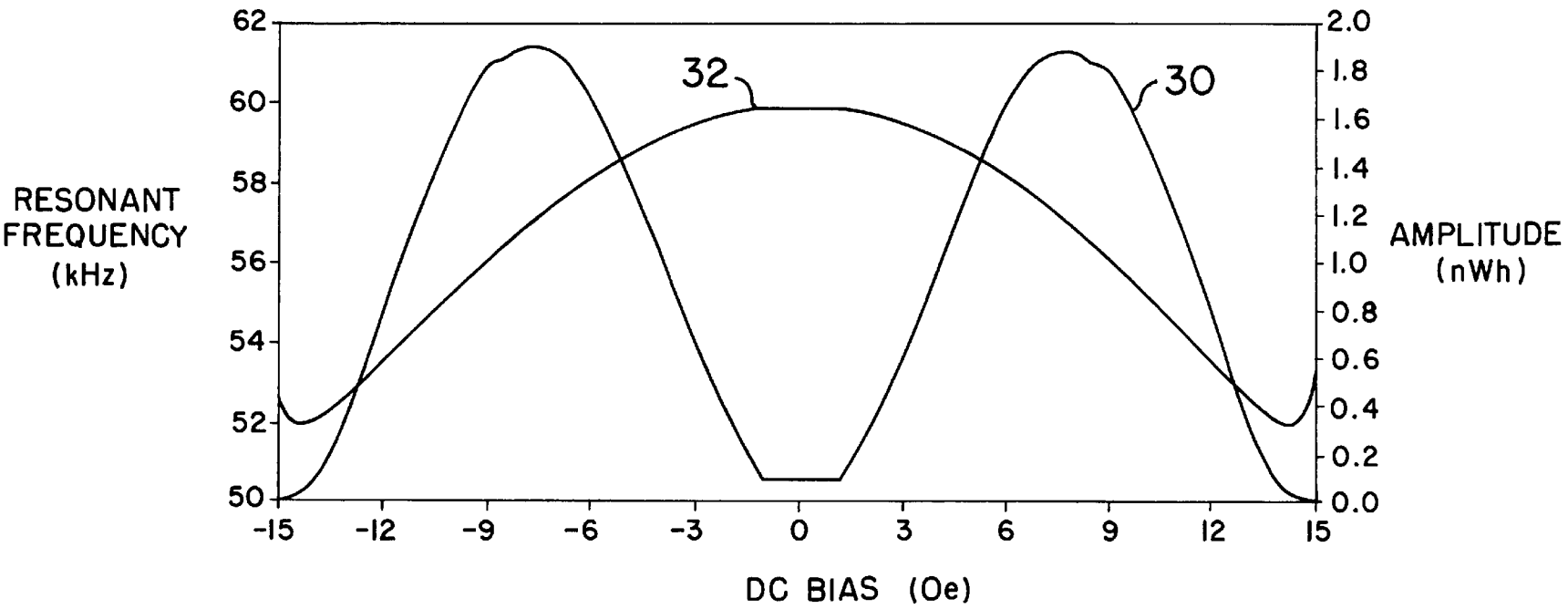
FIG. 2 (PRIOR ART)
FIG. 2 illustrates resonant frequency and amplitude characteristics of a magnetomechanical marker according to the prior art.
Figure 3:
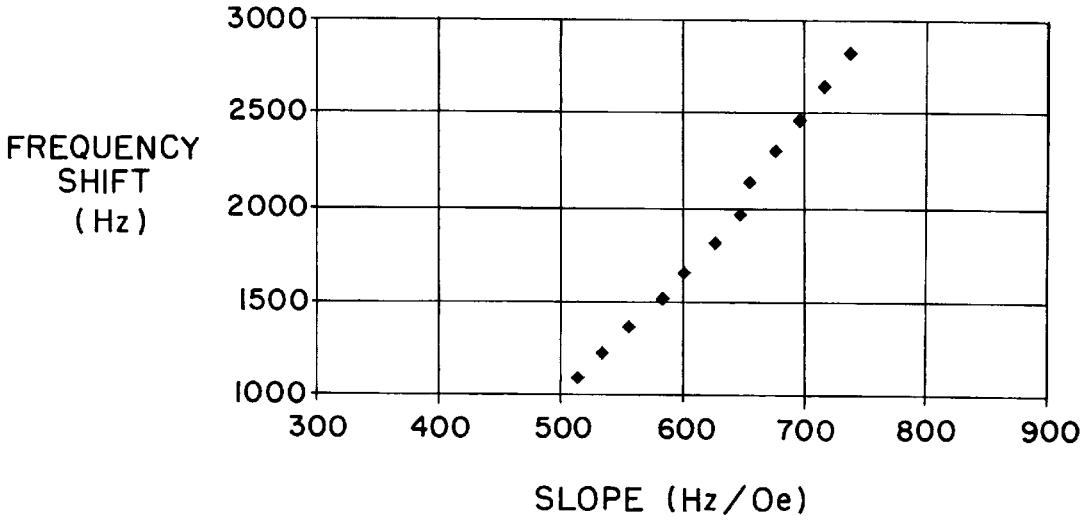
FIG. 3 (PRIOR ART)
FIG. 3 is a graph which presents in another form resonant frequency characteristic information represented in FIG. 2.
Figure 4:
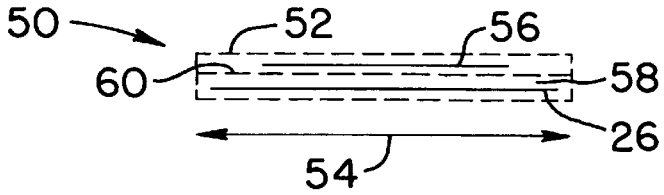
FIG. 4 is a schematic side view of a magnetomechanical EAS marker according to the present invention.

A preferred embodiment of the invention will now be described, initially with reference to FIG. 4. In FIG. 4, reference numeral 50 generally indicates a magnetomechanical EAS marker in accordance with the invention. The marker 50 includes a housing 52, which is shown in phantom and has a longitudinal axis oriented as indicated by double-headed arrow 54. Housed within the housing 52 are a magnetostrictive active element 26 and a bias magnet 56. The long dimensions of the active element and the bias magnet are parallel to arrow 54. The housing 52 and the active element 26 may be the same as corresponding components of conventional magnetomechanical EAS markers. The bias magnet 56 is preferably made of an alloy strip material used in bias magnets in conventional magnetomechanical EAS markers, but magnet 56 has a long dimension that is shorter than the length of conventional bias magnets. According to a preferred embodiment of the invention, the length (L) of the active element 26 is substantially 1.5 inches, and the length of the bias magnet 56 is substantially 0.9 inch so that the length of the bias magnet is substantially 0.6 L.

As in conventional magnetomechanical EAS markers, the bias magnet 56 is preferably fixedly mounted to the housing 52, and the active element 26 rests in a cavity 58 that is shaped and sized to accommodate the mechanical resonance of the active element 26 which occurs in response to the interrogation signal provided by the EAS detection equipment. As is also conventional, it is preferred that the housing 52 of the marker include a wall 60 to separate the active element 26 from the bias magnet 56 to prevent the active element 26 from being clamped by magnetic attraction to the bias magnet 56.

Figure 5:
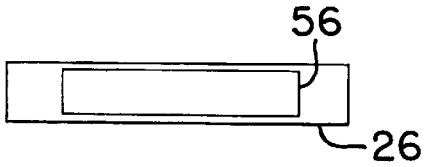
FIG. 5 is a plan view of the magnetomechanical EAS marker of FIG. 4, with housing structure of the marker removed.

FIG. 5 is a plan view of the marker 50 of FIG. 4, with the housing removed to show only the active element 26 and the bias magnet 56. As seen from FIG. 5, both the active element 26 and the bias magnet 56 exhibit a profile (i.e. a shape in their respective planes) which is rectangular. As noted before, the bias magnet 56 is considerably shorter in its longest dimension than is the active element 26. It has found to be desirable that the width of the bias magnet 56 be slightly less than the width of the active element 26 to avoid an unfavorable bias field distribution that would occur if the bias magnet 56 were to overhang the active element 26 in the width-wise direction. According to a preferred embodiment of the invention, the width of the active element 26 may be substantially 0.25 inch, and the width of the bias magnet 56, in that case, is slightly less than 0.25 inch. The rectangular top surface of the active element 26 has an area A, which of course is the product of the length and width of the active element. Preferably the rectangular top surface of the bias magnet 56 has an area of substantially 0.6 A.

Figure 6:
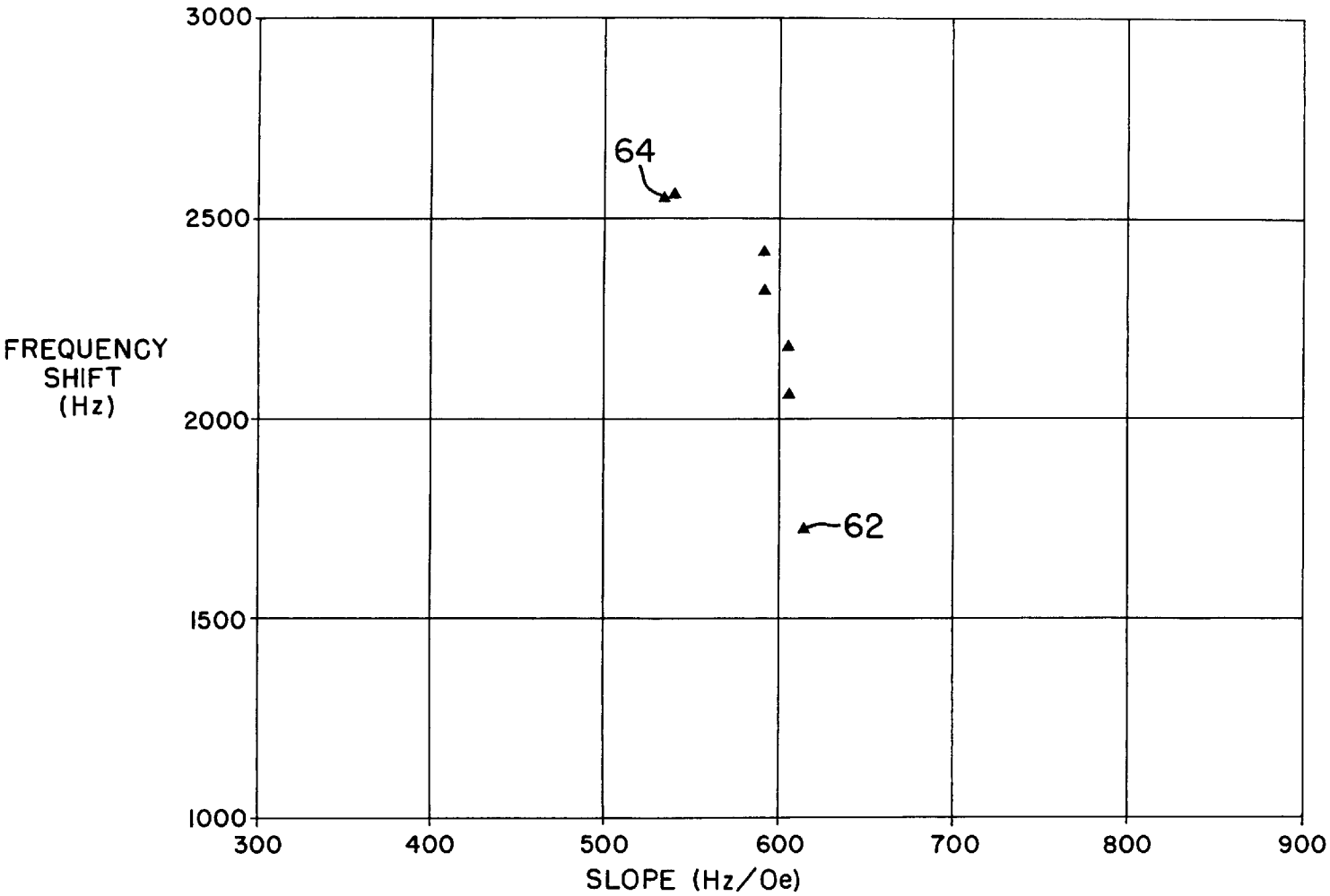
FIG. 6 graphically illustrates frequency shift and resonant-frequency-curve slope data according to variations in the size of the bias magnet relative to the active element of a magnetomechanical marker.
Figure 7:
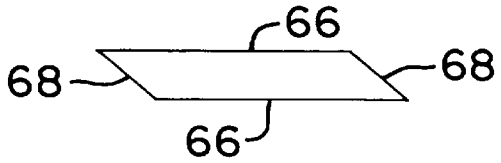
FIGS. 7–11 are plan views showing various alternative shapes of bias magnets that may be used in the magnetomechanical marker of FIG. 4.
Figure 8:
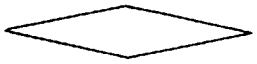
Figure 9:
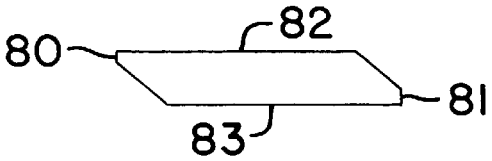
Figure 10:
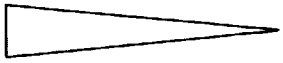

FIG. 6 presents data which indicates how reducing the length and/or the surface area of the bias magnet relative to the active element enhances the deactivation frequency shift without increasing the slope of the resonant frequency characteristic curve. The data shown in FIG. 6 were produced using an active element 26 that was substantially 1.5 inches long. The seven data points shown in FIG. 6 range from a first data point 62 to a seventh data point 64 and correspond to measured deactivation frequency shift and resonant-frequency-curve slope data for various lengths of the bias magnet. The first data point 62 corresponds to a bias magnet having a length substantially the same as the length of the active element, that is 1.5 inch, and the seventh data point 64 corresponds to a bias magnet having a length of 0.75 inch, i.e. substantially one-half the length of the active element. The intervening data points in the series correspond to reductions in length of the bias magnet in steps of 0.125 inch. It will be observed from the data presented in FIG. 6 that, as the length of the bias magnet is reduced, the deactivation frequency shift is increased, with no increase or a modest decrease in the slope of the resonant frequency characteristic curve.

It has been found that an optimum ratio of the lengths and/or surface areas of the bias magnet and the active element is substantially 0.6. With this ratio, the deactivation frequency shift is enhanced with a modest reduction in the resonant frequency characteristic curve slope, and an acceptable diminution in output signal amplitude. It is not contemplated to reduce the length or surface area of the bias magnet to less than half the length or surface area of the active element, since such a reduction provides little in the way of benefit, while continuing to diminish the output signal amplitude.

It is a striking feature of the data of FIG. 6 that the deactivation frequency shift is not positively correlated with the resonant frequency curve slope, as the bias magnet length is varied. Consequently, it is possible to enhance the deactivation frequency shift by reducing the bias magnet length or surface area without increasing the resonant-frequency-curve slope. Thus, the reliability of marker deactivation operations can be enhanced without significantly compromising marker detection operations.

It is believed that the effective distribution of the bias field provided by the bias magnet is controlled by two factors, namely the demagnetization effect at the ends of the bias magnet, and the particular flux path of the magnetic circuit as dictated by the bias magnet geometry. Shortening the bias magnet tends to increase the effective bias magnetic field by bringing the poles of the magnet closer together. On the other hand, with the bias magnet shorter than the active element, a portion of the active element is not properly biased, which tends to reduce signal amplitude.

Figure 11:
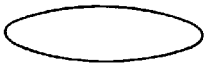

Although the invention can be satisfactorily practiced by means of a bias magnet having a rectangular profile as shown in FIG. 5, it is also contemplated to provide bias magnets having other shapes in profile, to obtain particularly advantageous combinations of deactivation frequency shift, resonant-frequency-curve slope, and output signal amplitude. Alternative profile shapes for the bias magnet are shown in FIGS. 7–11 and include an acute-angle parallelogram (FIG. 7), which has long sides 66 and short sides 68 that are shorter than long sides 66; a "diamond" shape or acute-angle rhombus (FIG. 8); a "Z-cut" shape (FIG. 9), which is an acute-angle parallelogram with the acute angle corners cut off (as indicated at 80, 81) perpendicular to the long sides 82, 83 of the bias magnet; a triangle (FIG. 10); and an ellipse (FIG. 11). It has previously been known to employ in magnetomechanical EAS markers bias magnets having rectangular, acute-angle parallelogram or z-cut profiles, but bias magnets in the diamond, triangular or elliptical shapes have not previously been proposed.

Figure 11A:
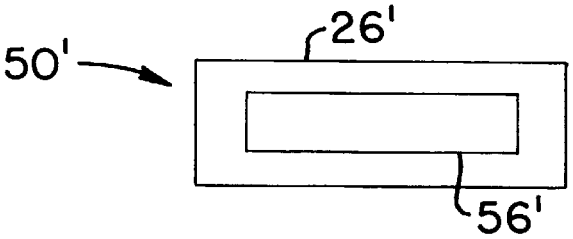
FIG. 11A is a plan view, like FIG. 5, of another embodiment of a magnetomechanical EAS marker provided according to the invention.

A magnetomechanical EAS marker according to another embodiment of the invention is indicated as reference numeral 50' in FIG. 11A. Like FIG. 5, FIG. 11A schematically shows the subject marker in plan view, with the marker housing removed. As seen from FIG. 11A, both the magnetostrictive element 26' and the bias magnet 56' have rectangular profiles. The magnetostrictive element 26' is the same as the corresponding element 26 of FIG. 5 except that the element 26' is twice as wide as the element 26. Preferably the bias magnet 56' is half the width and three-fourths of the length of the magnetostrictive element 26'. Thus the ratio of the surface areas of the magnetostrictive element and the bias magnet is 1:0.375. The bias magnet 56' is fixedly mounted on the marker housing (not shown) in a central position in the lengthwise and widthwise directions relative to the cavity in which the magnetostrictive element is housed.

It was noted above that it was undesirable to have the bias magnet overhang the magnetostrictive element in the widthwise direction. The reduced width of the bias magnet relative to the magnetostrictive element ensures that overhanging does not occur. If overhanging were to take place, the effective bias field applied to the magnetostrictive element would be reduced, which would raise the marker resonant frequency above the nominal frequency.

Although the reduction in width of the bias magnet relative to the magnetostrictive element does not significantly enhance the above-discussed trade-off of deactivation frequency shift versus resonant-frequency-curve slope, a marker having a magnetostrictive element dimensioned 1.5 in. by 0.5 in. and a bias magnet dimensioned 1.125 in. by 6 mm (just less than 0.25 in.) was found to operate very satisfactorily. Increasing the length of the bias magnet to 1.25 in. while maintaining a 6 mm width also provides a satisfactory marker. It is believed that additional modest reductions in the width and/or length of the bias magnet, resulting in a surface area as low as 30% of the surface area of the magnetostrictive element, would also provide a marker having favorable operating characteristics.

Figure 12:
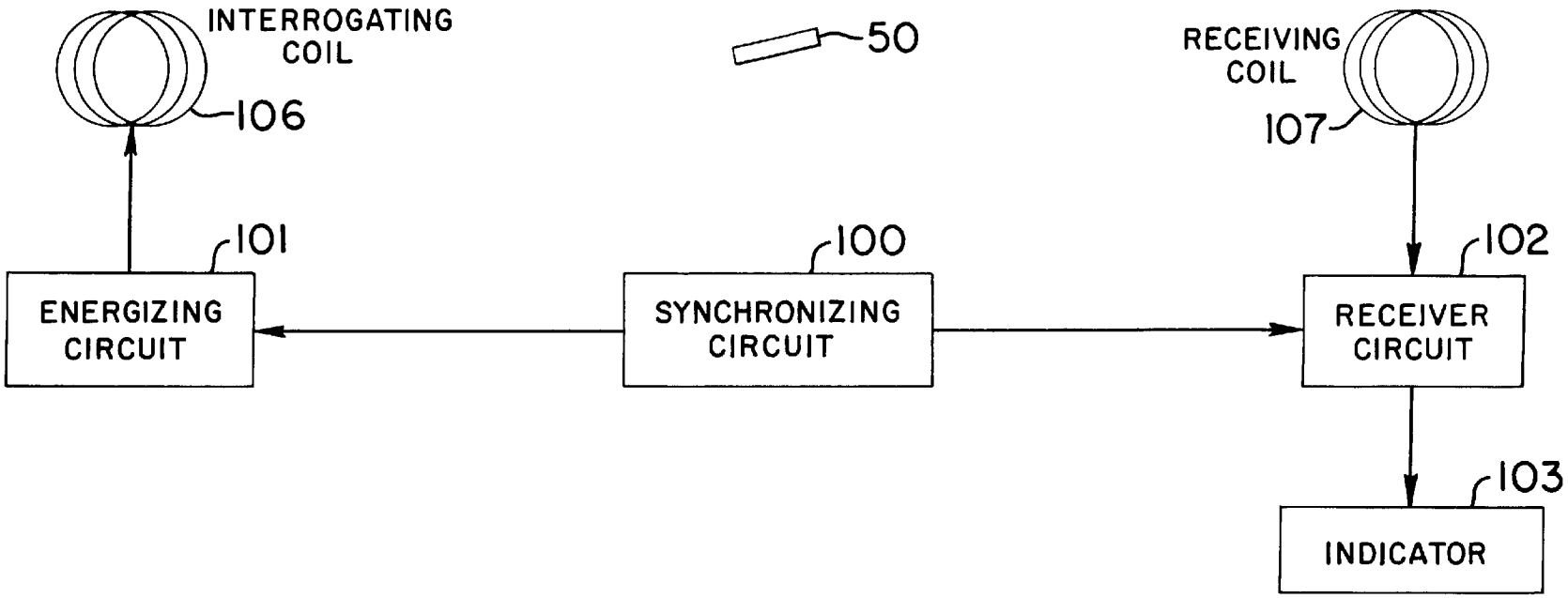
FIG. 12 is a block diagram of a magnetomechanical EAS system which uses the marker of FIG. 4.

FIG. 12 illustrates a pulsed-interrogation EAS system which uses a magnetomechanical marker 50 (or 50') fabricated in accordance with the invention. The system shown in FIG. 12 includes a synchronizing circuit 100 which controls the operation of an energizing circuit 101 and a receiving circuit 102. The synchronizing circuit 100 sends a synchronizing gate pulse to the energizing circuit 101 and the synchronizing gate pulse activates the energizing circuit 101. Upon being activated, the energizing circuit 101 generates and sends an interrogation signal to interrogating coil 106 for the duration of the synchronizing pulse. In response to the interrogation signal, the interrogating coil 106 generates an interrogating magnetic field, which, in turn, excites the marker 50 into mechanical resonance.

Upon completion of the pulsed interrogation signal, the synchronizing circuit 100 sends a gate pulse to the receiver circuit 102 and the latter gate pulse activates the circuit 102. During the period that the circuit 102 is activated, and if a marker is present in the interrogating magnetic field, such marker will generate in the receiver coil 107 a signal at the frequency of mechanical resonance of the marker. This signal is sensed by the receiver 102, which responds to the sensed signal by generating a signal to an indicator 103 to generate an alarm or the like. Accordingly, the receiver circuit 102 is synchronized with the energizing circuit 101 so that the receiver circuit 102 is only active during quiet periods between the pulses of the pulsed interrogation field.

Various changes in the foregoing marker and modifications in the described practices may be introduced without departing from the invention. The particularly preferred embodiments of the invention are thus intended in an illustrative and not limiting sense. The true spirit and scope of the invention are set forth in the following claims.

What is claimed is:

1. A magnetomechanical EAS marker, comprising:

a magnetostrictive element;

a bias magnet; and means for mounting said magnetostrictive element and said bias magnet in proximity to each other;

said magnetostrictive element and said bias magnet both being substantially planar metal strips, said magnetostrictive element having a top surface area A, said bias magnet having a top surface area less than 0.75 A.

2. A magnetomechanical EAS marker according to claim 1, wherein the top surface area of said bias magnet is less than 0.70 A.

3. A magnetomechanical EAS marker according to claim 2, wherein the top surface area of said bias magnet is not less than about 0.30 A.

4. A magnetomechanical EAS marker according to claim 3, wherein the top surface area of said bias magnet is substantially equal to 0.60 A.

5. A magnetomechanical EAS marker according to claim 1, wherein said bias magnet has a substantially rectangular profile.

6. A magnetomechanical marker according to claim 5, wherein said bias magnet has a width that is substantially one-half of a width of the magnetostrictive element and a length is substantially three-fourths of a length of the magnetostrictive element.

7. A magnetomechanical EAS marker according to claim 1, wherein said bias magnet has a profile that is substantially an acute parallelogram.

8. A magnetomechanical EAS marker according to claim 1, wherein said bias magnet has a profile that is substantially an ellipse.

9. A magnetomechanical EAS marker, comprising:

a magnetostrictive element;

a bias magnet; and means for mounting said magnetostrictive element and said bias magnet in proximity to each other;

said magnetostrictive element and said bias magnet both being substantially planar metal strips, said magnetostrictive element having a longest dimension measuring L, said bias magnet having a longest dimension measuring less than 0.75 L.

10. A magnetomechanical EAS marker according to claim 9, wherein the longest dimension of said bias magnet measures less than 0.70 L.

11. A magnetomechanical EAS marker according to claim 10, wherein the longest dimension of said bias magnet measures not less than about 0.50 L.

12. A magnetomechanical EAS marker according to claim 11, wherein the longest dimension of said bias magnet is substantially equal to 0.60 L.

13. A magnetomechanical EAS marker according to claim 9, wherein said bias magnet has a substantially rectangular profile.

14. A magnetomechanical EAS marker according to claim 9, wherein said bias magnet has a profile that is substantially an acute parallelogram.

15. A magnetomechanical EAS marker according to claim 9, wherein said bias magnet has a profile that is substantially an ellipse.

16. A magnetomechanical EAS marker, comprising:

a magnetostrictive element;

a bias magnet; and means for mounting said magnetostrictive element and said bias magnet in proximity to each other;

said magnetostrictive element and said bias magnet both being substantially planar metal strips, said bias magnet having a profile shaped in accordance with one of the group consisting of a rhombus, a triangle and an ellipse.

17. A magnetomechanical electronic article surveillance system, comprising:

(a) generating means for generating an electromagnetic field alternating at a selected frequency in an interrogation zone, said generating means including an interrogation coil;

(b) a marker secured to an article appointed for passage through said interrogation zone, said marker including a magnetostrictive element and a bias magnet located adjacent to said magnetostrictive element, said magnetostrictive element and said bias magnet both being substantially planar metal strips, said magnetostrictive element having a top surface area A, said bias magnet having a top surface area less than 0.75 A, said bias magnet providing a biasing magnetic field such that said magnetostrictive element is mechanically resonant when exposed to said alternating field; and (c) detecting means for detecting said mechanical resonance of said magnetostrictive element.

18. A magnetomechanical electronic article surveillance system according to claim 17, wherein the top surface area of said bias magnet is less than 0.70 A.

19. A magnetomechanical electronic article surveillance system according to claim 18, wherein the top surface area of said bias magnet is not less than about 0.30 A.

20. A magnetomechanical electronic article surveillance system according to claim 19, wherein the top surface area of said bias magnet is substantially equal to 0.60 A.

21. A magnetomechanical electronic article surveillance system according to claim 19, wherein the top surface area of said bias magnet is substantially equal to 0.375 A.

* * * * *

UNITED STATES PATENT AND TRADEMARK OFFICE

CERTIFICATE OF CORRECTION

PATENT NO. : 6,067,015

DATED : May 23, 2000

INVENTOR(S) : Ming-Ren Lian, et al.

It is certified that error appears in the above-identified patent and that said Letters Patent is hereby corrected as shown below:

On the title page, item 73, the text reading "Senormatic" should be corrected to read --Sensormatic--.

Signed and Sealed this

Eighth Day of May, 2001

*Attest:*

Nicholas P. Godici

NICHOLAS P. GODICI

*Attesting Officer*

*Acting Director of the United States Patent and Trademark Office*